US010429795B2

(12) United States Patent
Saeki et al.

(10) Patent No.: US 10,429,795 B2
(45) Date of Patent: Oct. 1, 2019

(54) IMAGE FORMING APPARATUS OPERABLE WITH A CARTRIDGE HAVING A MEMORY AND A TERMINAL

(71) Applicant: Brother Kogyo Kabushiki Kaisha, Nagoya (JP)

(72) Inventors: Masahito Saeki, Nagoya (JP); Tomoyuki Mizuno, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 38 days.

(21) Appl. No.: 15/918,038

(22) Filed: Mar. 12, 2018

(65) Prior Publication Data

US 2018/0335752 A1 Nov. 22, 2018

(30) Foreign Application Priority Data

May 17, 2017 (JP) ..... 2017-097797

(51) Int. Cl.
*G03G 21/18* (2006.01)
*G03G 21/16* (2006.01)

(52) U.S. Cl.
CPC ..... *G03G 21/1892* (2013.01); *G03G 21/185* (2013.01); *G03G 21/1814* (2013.01); *G03G 21/1857* (2013.01); *G03G 21/1867* (2013.01); *G03G 21/1885* (2013.01); *G03G 21/1633* (2013.01); *G03G 2215/0697* (2013.01)

(58) Field of Classification Search
CPC ..... G03G 21/1892; G03G 21/1814; G03G 21/1633; G03G 21/1867; G03G 21/1885; G03G 21/185; G03G 21/1857; G03G 21/1842; G03G 21/1875; G03G 21/1878; G03G 2215/0697
See application file for complete search history.

(56) References Cited

U.S. PATENT DOCUMENTS 5,926,666 A * 7/1999 Miura ..... G03G 21/1885 399/25
9,823,621 B2 * 11/2017 Miyamoto ..... G03G 21/1814
(Continued)

FOREIGN PATENT DOCUMENTS

JP 2003-195726 A 7/2003

*Primary Examiner* — Walter L Lindsay, Jr.
*Assistant Examiner* — Arlene Heredia
(74) *Attorney, Agent, or Firm* — Burr & Brown, PLLC

(57) ABSTRACT

An image forming apparatus operable in conjunction with a cartridge having a memory and a terminal, which is electrically connected with the memory and arranged on a downward face of the cartridge, is provided. The image forming apparatus includes a housing having an opening, a controller, and a supporter to support the cartridge at an attachment position. The supporter includes a guiding portion to guide the cartridge there-along and a memory electrode electrically connected with the controller. The guiding portion guides the cartridge being attached to the attachment position to descend as the cartridge approaches from the opening to the attachment position. The memory electrode protrudes upward at a position lower than the terminal on the cartridge and has a height to contact the terminal to electrically connect the controller with the memory when the cartridge is at the attachment position.

6 Claims, 14 Drawing Sheets

(56) References Cited

U.S. PATENT DOCUMENTS

| | | | | |
|---|---|---|---|---|
| 2002/0191981 | A1* | 12/2002 | Miyabe | B29C 45/14467 399/90 |
| 2003/0123896 | A1 | 7/2003 | Goto et al. | |
| 2016/0266539 | A1* | 9/2016 | Watanabe | G03G 21/1633 |

* cited by examiner

IMAGE FORMING APPARATUS OPERABLE WITH A CARTRIDGE HAVING A MEMORY AND A TERMINAL

CROSS REFERENCE TO RELATED APPLICATION

This application claims priority from Japanese Patent Application No. 2017-097797, filed on May 17, 2017, the entire subject matter of which is incorporated herein by reference.

BACKGROUND

Technical Field

An aspect of the present disclosure is related to an image forming apparatus.

Related Art

An image forming apparatus, in which a cartridge is detachably attachable to a body thereof, is known. The cartridge for the image forming apparatus may include, for example, a photosensitive drum, a developer roller to supply toner to the photosensitive drum to form a toner image on the photosensitive drum, and a frame.

The cartridge for the image forming apparatus may be equipped with an IC memory. For example, the body of the image forming apparatus may have a pivot arm, which may pivot about a shaft extending in a direction orthogonal to an attachable/detachable direction of the cartridge, and an electrode may be attached to the pivot arm. When the cartridge is being attached to the body, the pivot arm may be pushed by the cartridge and pivot, and the electrode may contact a terminal of the IC memory on the cartridge. Thus, information in the IC memory in the cartridge may be transferred to the image forming apparatus. When the cartridge is being detached from the body, the pivot arm may be released from the pressure of the cartridge and may pivot by resiliency of a spring, and the electrode may retract to be separated from the terminal of the IC memory.

SUMMARY

The image forming apparatus in the known configuration may require a movable structure, such as the pivot arm, to move the electrode in response to the attaching or detaching motion of the cartridge, but the movable structure may prevent the image forming apparatus from downsizing.

The present disclosure is advantageous in that an image forming apparatus, in which a movable structure to move an electrode in response to attachment or detachment of a cartridge may be omitted, is provided.

According to an aspect of the present disclosure, an image forming apparatus operable in conjunction with a cartridge, having a memory and a terminal arranged on a downward surface of the cartridge and electrically connected with the memory, is provided. The image forming apparatus includes a housing having an opening, through which the cartridge is detachably attachable to the housing, a controller arranged inside the housing, and a supporter configured to support the cartridge at an attachment position. The supporter includes a guiding portion, which is configured to guide the cartridge there-along, and a memory electrode, which is electrically connected with the controller. The guiding portion is configured to guide the cartridge being attached to the attachment position to descend as the cartridge approaches from the opening to the attachment position. The memory electrode protrudes upward at a position lower than the terminal on the cartridge and has a height to contact the terminal to electrically connect the controller with the memory when the cartridge is at the attachment position.

BRIEF DESCRIPTION OF THE ACCOMPANYING DRAWINGS

DETAILED DESCRIPTION

Hereinafter, an embodiment of the present disclosure will be described with reference to the accompanying drawings.

<Exterior Configuration of Printer>

Figure 1:
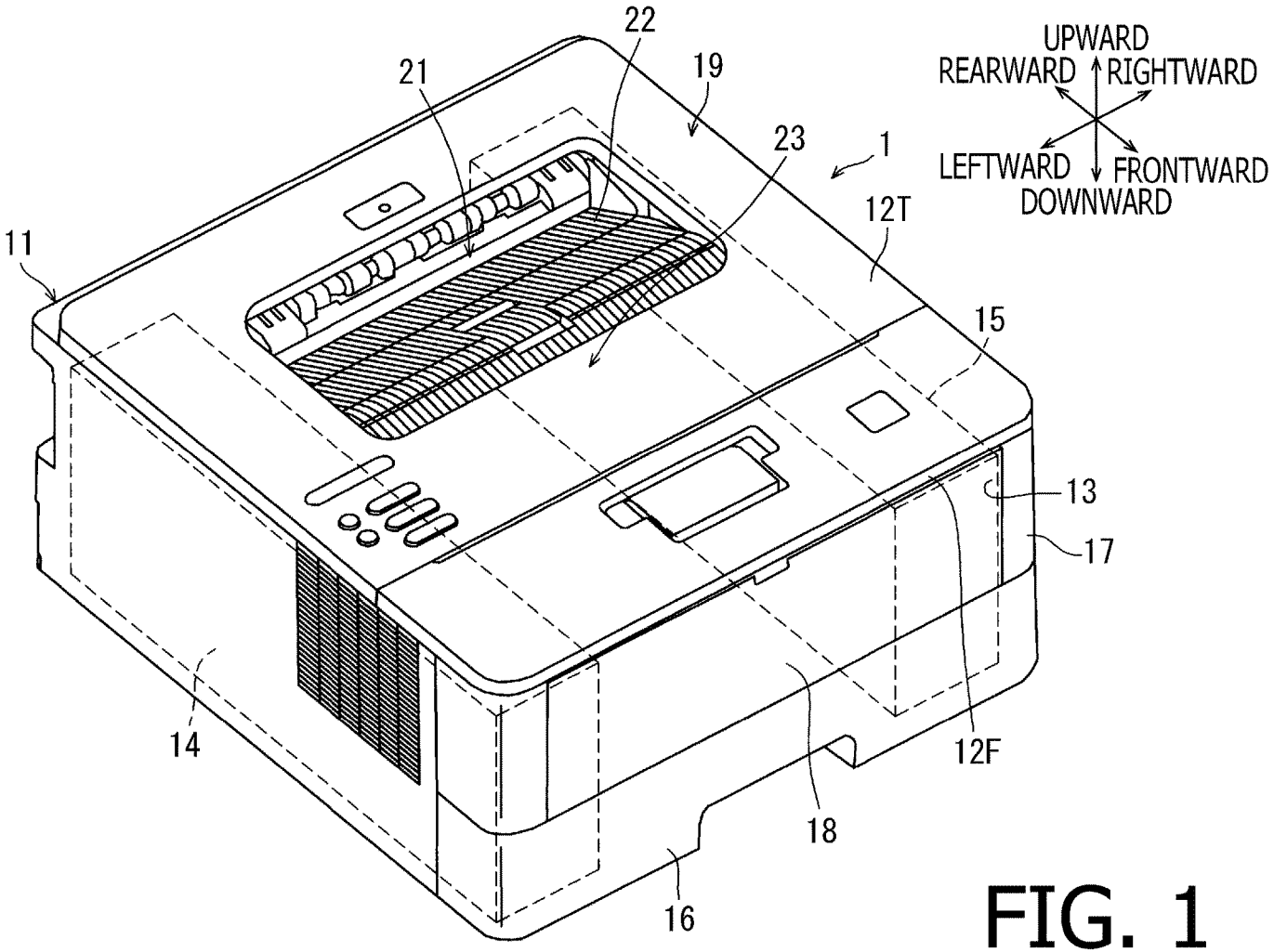
FIG. 1 is a perspective view of a printer according to an embodiment of the present disclosure.

A printer 1 shown in FIG. 1 is a monochrome laser printer and includes a housing 11 having an approximate shape of a rectangular box. The housing 11 includes an opening 13, which is formed continuously over a side face 12F and on an upper face 12T.

In the following description, directions related the printer 1 and each part or item included in the printer 1 will be mentioned on basis of indications by arrows in each drawing. For example, a side, on which the opening 13 is arranged, may be referred to a frontward side. A side opposite to the frontward side may be referred to as a rearward side. A front-to-rear or a rear-to-front direction may be referred to as a front-rear direction. A user may face the side face 12F in order to ordinarily use the printer 1, and the user's right-hand side and left-hand side may be referred to a rightward side and a leftward side, respectively, and a left-to-right or right-to-left direction may be referred to as a widthwise direction. An up-to-down or down-to-up direction may be referred to as a vertical direction.

The housing 11 includes a first frame 14 and a second frame 15, which may be made of resin. The first frame 14 and the second frame 15 are arranged laterally on a leftward side and a rightward side of the opening 13, respectively, to be spaced apart from each other along the widthwise direction to face each other across the opening 13.

At a lower position, e.g., a bottom, of the housing 11, arranged is a feeder tray 16, which is movable to be drawn outward and pushed inward. In other words, in a lower area between the first frame 14 and the second frame 15, the feeder tray 16 may be attached to the housing 11 in an attached position at the bottom of the housing 11 movably to be drawn frontward. The feeder tray 16 may support one or more sheets S in a stack thereon.

At an upper position with respect to a frontward end of the feeder tray 16 being in the attached position, arranged is a front cover 17. The front cover 17 is pivotably supported by a front frame 200, which is arranged between the first frame 14 and the second frame 15 along the widthwise direction. The front cover 17 is pivotable between an open position and a closure position. In the open position, the front cover 17 is turned frontward to expose the opening 13 between the first frame 14 and the second frame 15. In the closure position, the front cover 17 covers the opening 13, upper portions of frontward surfaces of the first frame 14 and the second frame 15, and frontward portions of upper end surfaces of the first frame 14 and the second frame 15.

A multipurpose tray 18 is attached to the front cover 17. The multipurpose tray 18 is movable between an unused position, in which the multipurpose tray 18 stands vertically along a frontward face of the front cover 17 being in the closure position, and a usable position, in which the multipurpose tray 18 tilts frontward to be higher frontward and lower rearward. In the usable position, the multipurpose tray 18 may support one or more sheets in a stack thereon. When the multipurpose tray 18 is in the usable position, on an inner side of the front cover 17, a sheet inlet (unsigned) through which an inside and an outside of the housing 11 are connected, is exposed.

The housing 11 includes a top cover 19, which may be made of resin. The top cover 19 is arranged over the first frame 14 and the second frame 15 to cover upper end surfaces of the first frame 14 and the second frame 15. At a rearward and widthwise central area in the top cover 19, formed is a dent 21, which dents downward. The dent 21 may have a rectangular form in a plan view and has a bottom surface 22, which inclines to be lower at the rear and higher at the front. The bottom surface 22, together with a frontward area on the upper face of the top cover 19 with respect to the dent 21 and an upper face of the front cover 17 in the closure position, forms an ejection tray 23.

<Interior Configuration of the Printer>

Figure 2:
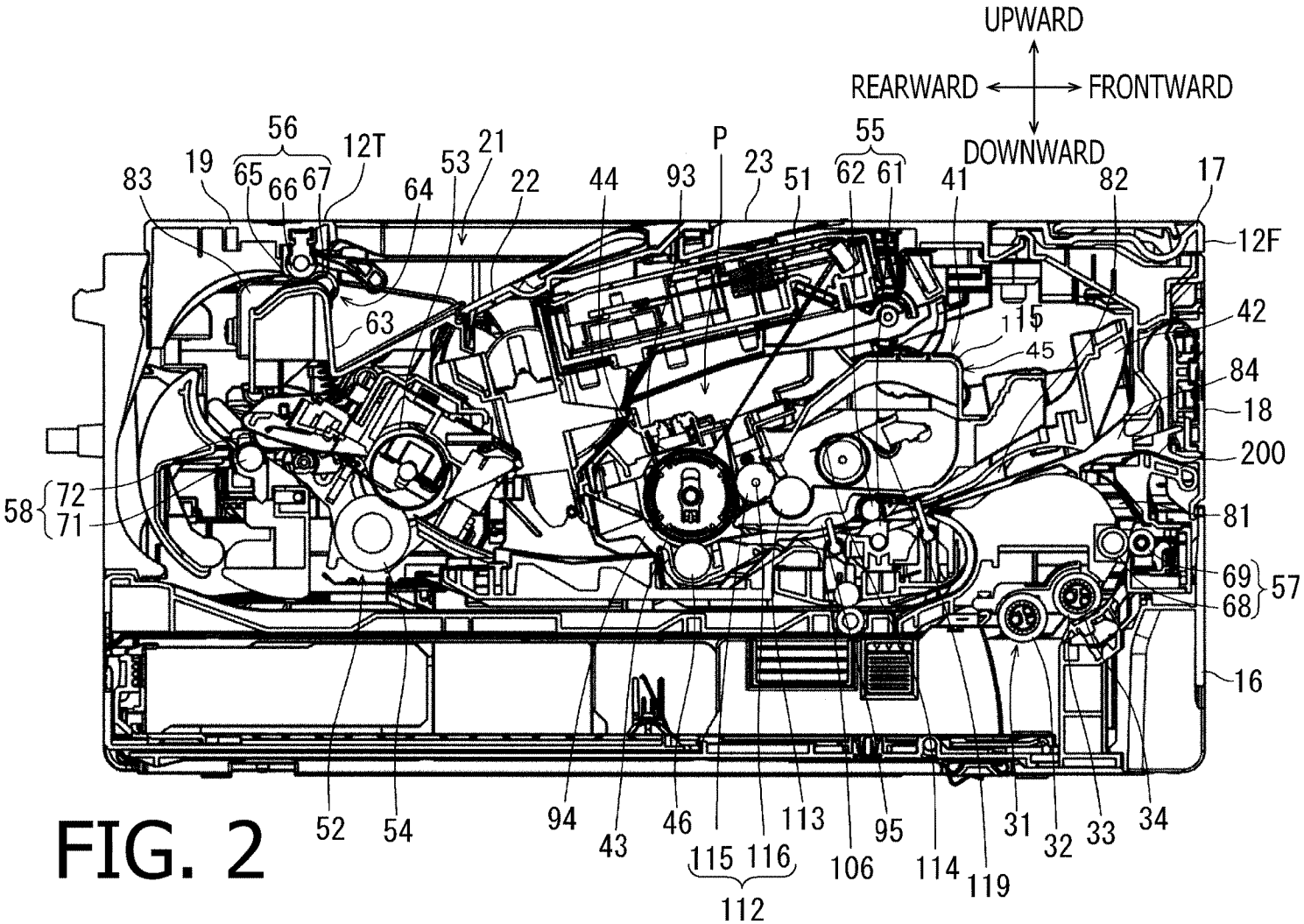
FIG. 2 is a cross-sectional view of the printer taken at a widthwise center according to the embodiment of the present disclosure.

Between the first frame 14 and the second frame 15, at an upper position with respect to a frontward part of the feeder tray 16, as shown in FIG. 2, arranged is a first feeder 31. The first feeder 31 includes a feed roller 32, a separator roller 33, and a separator pad 34.

The feed roller 32 is rotatable about an axis, which extends in the widthwise direction. When the feeder tray 16 is at the attached position in the housing 11, a circumferential surface of the feed roller 32 may contact a frontward end area on an upper surface of a topmost sheet in the sheets stored in the feeder tray 16.

The separator roller 33 is arranged at a frontward position with respect to the feed roller 32 and is rotatable about an axis, which extends in the widthwise direction.

The separator pad 34 may contact a circumferential surface of the separator roller 33 at a lower-frontward position with respect to the separator roller 33 when the feeder tray 16 is at the attached position in the housing 11.

On an inner side of the sheet inlet in the front-rear direction, i.e., at a rearward position with respect to the sheet inlet, which may be exposed when the multipurpose tray 18 is in the usable position, arranged is a second feeder (not shown) to feed sheets on the multipurpose tray 18 inside the housing 11.

In the housing 11, on an inner side of the first feeder 31 and the second feeder in the front-rear direction, i.e. at a rearward position with respect to the first feeder 31 and the second feeder, arranged is a process cartridge 41 at a cartridge-attachment position P. The process cartridge 41 includes a cartridge frame 42, which holds a photosensitive drum 43, a charger 44, a developer device 45, and a transfer roller 46, thereon. In the following description, positions and orientations of the photosensitive drum 43, the charger 44, and the developer device 45, and the transfer roller 46 may be based on a condition, wherein the process cartridge 41 is located at the cartridge-attachment position P.

The photosensitive drum 43 is held rotatably at a rearward end position in the cartridge frame 42 to rotate about an axis, which extends in the widthwise direction.

The charger 44 is arranged at an upper-rearward position with respect to the photosensitive drum 43. The charger 44 may be, for example, a scorotron charger having a wire and a grid.

The developer device 45 is arranged at a frontward position with respect to the photosensitive drum 43.

The transfer roller 46 is arranged at a lower position with respect to the photosensitive drum 43 to face the photosensitive drum 43 vertically. The transfer roller 46 is rotatable about an axis, which extends in the widthwise direction.

The process cartridge 41 may be attached to the cartridge-attachment position P in the housing 11 and removed from the cartridge-attachment position P to be separated from the housing 11 through the opening 13 while the front cover 17 is in the open position.

Inside the housing 11, at an upper position with respect to the cartridge-attachment position P, arranged is an exposure device 51. The exposure device 51 includes an optical system, including a laser emitter and polygon mirrors, to emit a laser beam at the photosensitive drum 43 according to image data. The laser beam emitted from the exposure device 51 may travel through an area between the charger 44 and the developer device 45 at a circumferential surface of the photosensitive drum 43 while the process cartridge 41 is at the cartridge-attachment position P.

Inside the housing 11, further, at a rearward position with respect to the cartridge-attachment position P, arranged is a fuser 52. The fuser 52 includes a heating roller 53 and a pressing roller 54. The heating roller 53 is rotatable about an axis, which extends in the widthwise direction. The pressing roller 54 is arranged at a lower-rearward position with respect to the heating roller 53 and is rotatable about an axis, which extends in the widthwise direction. A circumferential surface of the pressing roller 54 contacts a circumferential surface of the heating roller 53.

Inside the housing 11, further, arranged are a registration roller 55, an ejection roller 56, a first conveyer roller 57, and a second conveyer roller 58.

The registration roller 55 is arranged at a frontward position with respect to the photosensitive drum 43 and the transfer roller 46 to be spaced apart from the photosensitive drum 43 and the transfer roller 46 for a predetermined distance. The registration roller 55 may includes a pair of rollers, which are a driving roller 61 and a driven roller 62. The driving roller 61 is held by the housing 11 rotatably to rotate about a shaft, which extends in the widthwise direction. The driven roller 62 is held by the cartridge frame 42 of the process cartridge 41 rotatably to rotate about an axis, which extends in the widthwise direction. When the process cartridge 41 is at the cartridge-attachment position P, a circumferential surface of the driven roller 62 at an upper-rearward position may contact a circumferential surface of the driving roller 61 at a lower-frontward position.

The housing 11 includes a wall face 63, which extends upward from a rearward end of the ejection tray 23, or from a rearward end of the bottom surface 22 in the dent 21. In the wall face 63, at an upper position spaced apart from the rearward end of the ejection tray 23, formed is a sheet outlet 64, through which the sheet may be ejected at the ejection tray 23.

The ejection roller 56 is arranged at a rearward position with respect to the sheet outlet 64. The ejection roller 56 includes a driving roller 65 and two (2) driven rollers 66, 67. The driving roller 65 and the driven rollers 66, 67 are arranged to contact one another at respective circumferential surfaces and are rotatable about respective axes, which extend in the widthwise direction.

The first conveyer roller 57 is arranged at an upper-frontward position with respect to the first feeder 31. The first conveyer roller 31 includes a pair of rollers, which are a driving roller 68 and a driven roller 69. The driving roller 68 and the driven roller 69 are arranged to contact each other at respective circumferential surfaces and are rotatable about respective axes, which extend in the widthwise direction.

The second conveyer roller 58 is arranged at an upper-rearward position with respect to the fuser 52 and at a lower-rearward position with respect to the ejection roller 56. The second conveyer roller 58 includes a pair of rollers, which are a driving roller 71 and a driven roller 72. The driving roller 71 and the driven roller 72 are arranged to contact each other at respective circumferential surfaces and are rotatable about respective axes, which extend in the widthwise direction.

In the housing 11, further, arranged are a first conveyer path 81, a second conveyer path 82, a third conveyer path 83, and a fourth conveyer path 84.

The first conveyer path 81 extends from a position between the separator roller 33 and the separator pad 34 through the first conveyer roller 57 and curves upper-rearward in an approximate shape of "U."

The second conveyer path 82 extends rearward continuously from the first conveyer path 81 through the registration roller 55, a position between the photosensitive drum 43 and the transfer roller 46, a position between the heating roller 53 and the pressing roller 54 in the fuser 52, in this mentioned order.

The third conveyer path 83 extends upper-rearward continuously from the second conveyer path 82 through the second conveyer roller 58, curves upper-frontward in an approximate shape of "U," and extends through the ejection roller 56 to the sheet outlet 64.

The fourth conveyer path 84 extends rearward from the multipurpose tray 18 being in the usable position and merges with the second conveyer path 82 from the front side.

<Printing Actions>

A sheet may be conveyed from a stack of sheets on the feeder tray 16 or on the multipurpose tray 18 to be fed to the process cartridge 41 in order to print an image on the sheet in the printer 1.

When the sheet is conveyed from the feeder tray 16, the feed roller 32 in the first feeder 31 may rotate counterclockwise in a view from the left (see FIG. 2). As the feed roller 32 rotates, the sheet being in contact with the circumferential surface of the feed roller 32 may be moved frontward. The sheet from the feeder tray 16 may be forwarded through the position between the separator roller 33 and the separator pad 34 to be separated from other sheets in the stack. The separated sheet may enter the first conveyer path 81. The sheet entering the first conveyer path 81 may be subjected to a conveying force from the first conveyer roller 57 and proceed in the first conveyer path 81 curving in the U-shape to turn rearward and enter the second conveyer path 82.

When the sheet is conveyed from a stack of sheets on the multipurpose tray 18, the second feeder may move the sheet rearward. The sheet may be separated from the stack of sheets, enter and proceed in the fourth conveyer path 84 toward the second conveyer path 82, and enter the second conveyer path 82 through a merging point between the fourth conveyer path 84 and the second conveyer path 82. The sheet entering the second conveyer path 82 may proceed rearward in the second conveyer path 82. Meanwhile, the registration roller 55 may not be rotating but may stay still. Therefore, when a leading edge of the sheet reaches the position between the paired rollers 61, 62 in the registration roller 55, the sheet may be stopped to pause thereat.

In the meantime, the photosensitive drum 43 may rotate clockwise in the view from the left (see FIG. 2). As the photosensitive drum 43 rotates, the circumferential surface of the photosensitive drum 43 may be charged evenly by the charger 44 and selectively exposed to the laser beam from the exposure device 51. Potential in areas on the circumferential surface of the photosensitive drum 43 exposed to the laser beam may be lowered to form an electrostatic latent image on the circumferential surface of the photosensitive drum 43. Thereafter, positively charged toner supplied by the developer device 45, or a developer roller 112 which will be described later in detail, may adhere to the electrostatic latent image carried on the circumferential surface of the photosensitive drum 43 so that the electrostatic image may be developed to be a toner image and carried on the circumferential surface of the photosensitive drum 43.

Forming the toner image on the circumferential surface of the photosensitive drum 43 is synchronized with conveyance of the sheet by regulating behaviors of the registration roller 55. The registration roller 55 once stopped rotating may start rotating at a predetermined timing to convey the sheet so that the sheet may reach the position between the photosensitive drum 43 and the transfer roller 46 when the toner image on the photosensitive drum 43 faces the transfer roller 46. Meanwhile, transfer bias is applied to the transfer roller 46. Therefore, as the sheet proceeds through the position between the photosensitive drum 43 and the transfer roller 46, the toner image may be transferred from the circumferential surface of the photosensitive drum 43 to an upper surface of the sheet due to an effect of the transfer bias.

The sheet with the toner image transferred thereon may proceed further rearward in the second conveyer path 82 to enter the fuser 52. In the fuser 52, the sheet proceeds through the position between the heating roller 53 and the pressing roller 54 while the toner image may be fixed onto the sheet by the heat and the pressure from the heating roller 53 and the pressing roller 54. With the heat and the pressure applied thereto, forming the image on the sheet may be completed. The sheet with the image formed thereon may exit the second conveyer path 82 and enter the third conveyer path 83.

The sheet entering the third conveyer path 83 may be subjected to a conveying force from the second conveyer roller 58 and proceeds in the third conveyer path 83 for the ejection roller 56. The sheet reaching the ejection roller 56 may be conveyed by the conveying force from the ejection roller 56 and ejected through the sheet outlet 64 to be released in the ejection tray 23.

Thus, in order to print an image on the sheet, the sheet may be conveyed from the feeder tray 16 or the multipurpose tray 18 through the conveyer path curved in two "U"s or an "S," i.e., through the first conveyer path 81, the second conveyer path 82, and the third conveyer path 83, and, after having the image formed thereon, the sheet may be ejected outside the housing 11 and released in the ejection tray 23.

<Process Cartridge>

Figure 4:
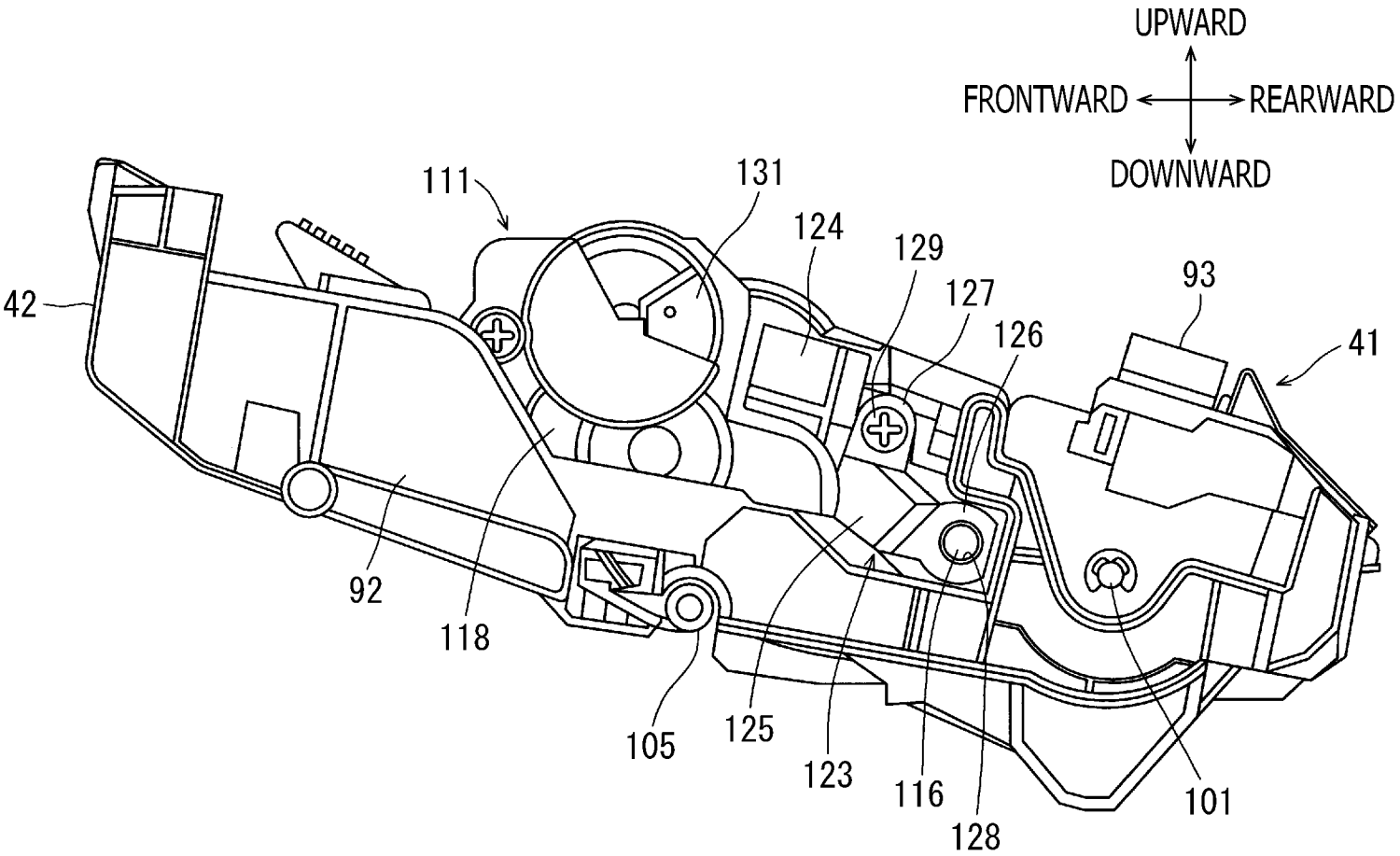
FIG. 4 is a rightward side view of the process cartridge for the printer according to the embodiment of the present disclosure.
Figure 5:
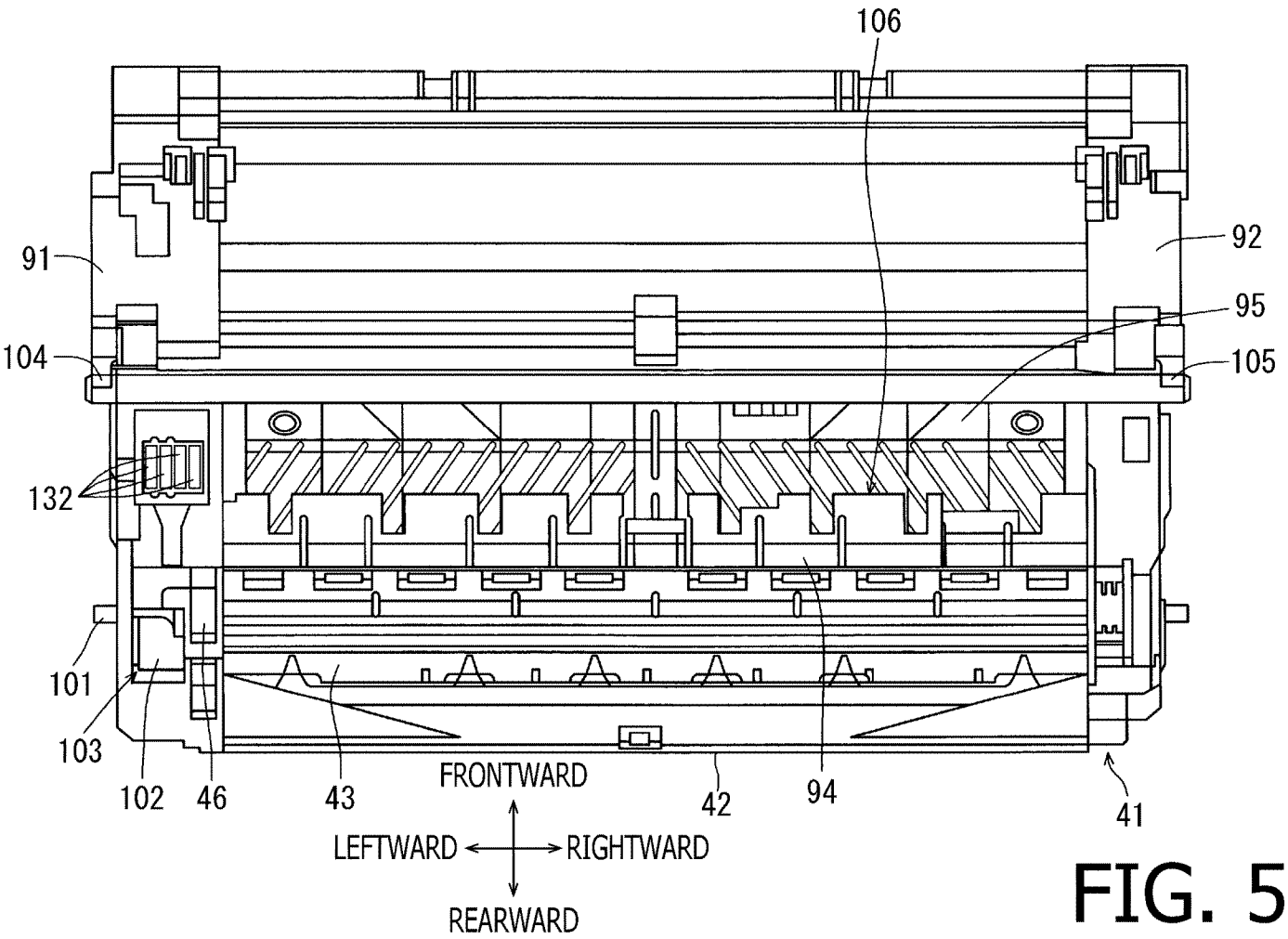
FIG. 5 is a bottom view of the process cartridge for the printer according to the embodiment of the present disclosure.

The cartridge frame 42 of the process cartridge 41 includes a leftward wall 91 (FIG. 3), a rightward wall 92 (FIG. 4), an upper wall 93 (FIGS. 3, 4), a rear-bottom wall 94 (FIG. 5), and a front-bottom wall 95 (FIG. 5).

The leftward wall 91 and the rightward wall 92 are, as shown in FIG. 5, arranged to be spaced apart along the widthwise direction from each other to face each other. The photosensitive drum 43 being in a cylindrical shape is arranged in an intermediate area between rearward end portions of the leftward wall 91 and the rightward wall 92. The photosensitive drum 43 is rotatable relatively to the leftward wall 91 and the rightward wall 92 about a drum shaft 101, which extends on a rotation axis of the photosensitive drum 43. Widthwise ends of the drum shaft 101 protrude outward through the leftward wall 91 and the rightward wall 92 and held by the leftward wall 91 and the rightward wall 92. The drum shaft 101 may not be rotatable relatively to the leftward wall 91 or the rightward wall 92. On a leftward end of the photosensitive drum 43, fixed is a drum gear 102. In the leftward wall 91, at a lower-rearward but horizontally at least partly coincident position with respect to the drum gear 102, formed is an opening 103. A circumferential surface of the drum gear 102 is partly exposed through the opening 103 to the outside of the leftward wall 91.

Between the rearward end portions of the leftward wall 91 and the rightward wall 92, further, the transfer roller 46 is rotatably supported.

The leftward wall 91 and the rightward wall 92 have roller holders 104, 105, respectively, at a central area in the front-rear direction. The roller holders 104, 105 hold a leftward end and a rightward end of the driven roller 62 in the registration roller 55 rotatably, respectively.

Figure 3:
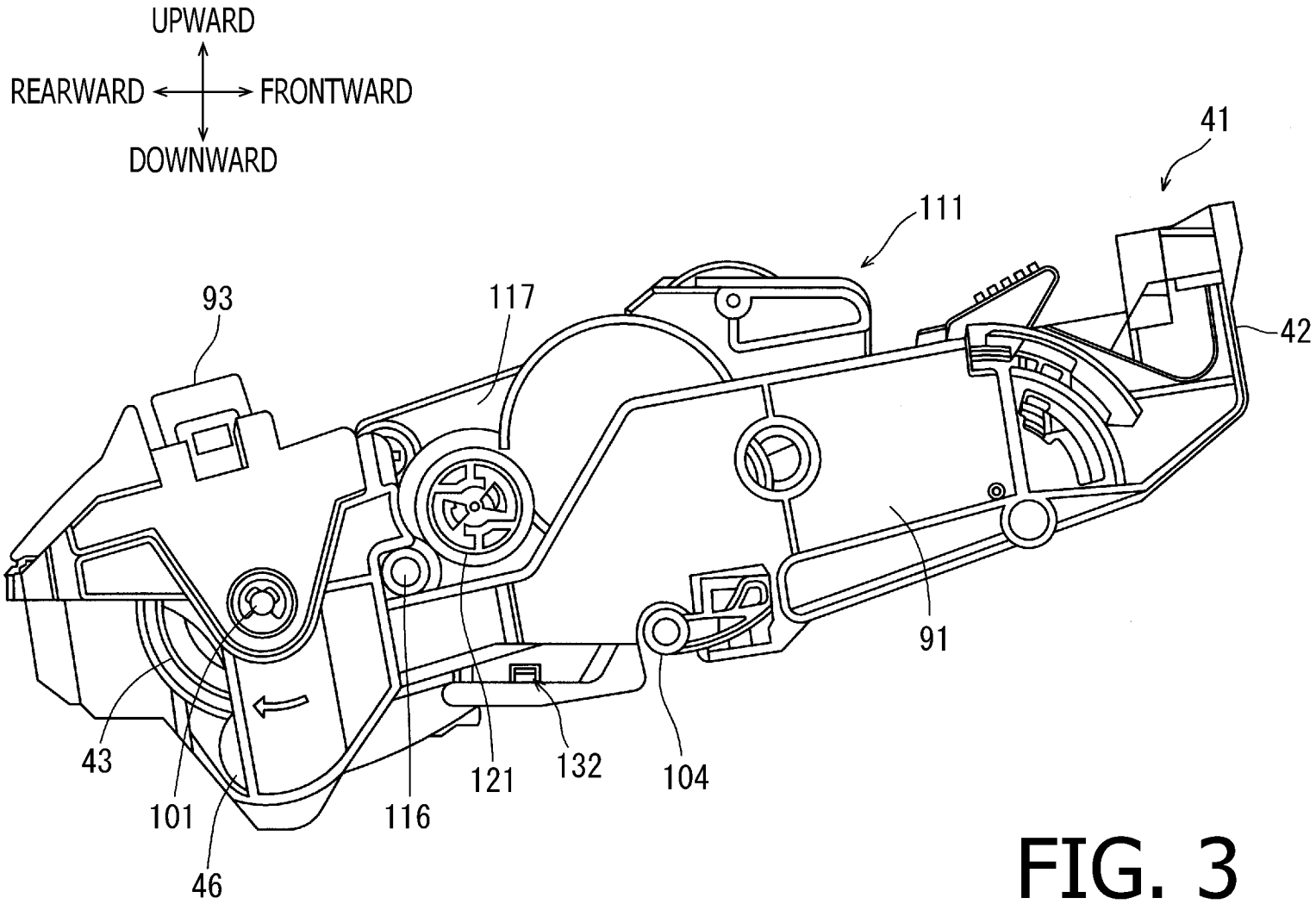
FIG. 3 is a leftward side view of a process cartridge for the printer according to the embodiment of the present disclosure.

The upper wall 93 is, as shown in FIGS. 3 and 4, arranged to connect rearward end portions of the leftward wall 91 and the rightward wall 92 over an intermediate area between the leftward wall 91 and the rightward wall 92 to face the photosensitive drum 43 from above and holds the charger 44.

The rear-bottom wall 94 is, as shown in FIG. 5, arranged to connect rearward end portions of the leftward wall 91 and the rightward wall 92 underneath the intermediate area between the leftward wall 91 and the rightward wall 92. A rearward end of the rear-bottom wall 94 is, as shown in FIG. 2, located at a lower spaced-apart position from the photosensitive drum 43 and at a rearward spaced-apart position from the transfer roller 46. The rear-bottom wall 94 extends frontward from the rearward end thereof, curving along the circumferential surface of the transfer roller 46, to a position to face a lower end of the circumferential surface of the transfer roller 46 and extends further frontward to be farther away from the circumferential surface of the transfer roller 46.

The front-bottom wall 95 is arranged to connect the leftward wall 91 and the rightward wall 92 underneath the intermediate area and extends frontward from a rearward position in the leftward wall 91 and the rightward wall 92, with respect to a center in the front-rear direction. A rearward end portion of the front-bottom wall 95 is at an upper spaced-apart position from a frontward end portion of the rear-bottom wall 94. In other words, the front-bottom wall 95 and the rear-bottom wall 94 overlap each other vertically at the rearward end portion and the frontward end portion, respectively. While the rearward end portion of the front-bottom wall 95 and the frontward end portion of the rear-bottom wall 94 are spaced apart from each other vertically, a slit 106, as shown in FIGS. 2 and 5, elongated in the widthwise direction is formed between the frontward end portion of the rear bottom wall 94 and the rearward end portion of the front bottom wall 95. The sheet conveyed through the registration roller 55 may pass through the slit 106 to enter the process cartridge 41 and proceed toward the position between the photosensitive drum 43 and the transfer roller 46. The sheet may thereafter pass through the position between the photosensitive drum 46 and the rearward end of the rear bottom wall 94 to exit the process cartridge 41.

At a position above the front-bottom wall 95, arranged is the developer device 45. The developer device 45 includes a developer housing 111 to store toner. In other words, the toner may be stored in the developer housing 111.

The developer device 45 includes, as shown in FIG. 2, a developer roller 112, a supplier roller 113, and an agitator 114.

The developer roller 112 includes a roller body 115 in a cylindrical shape and a roller shaft 116 extending on a rotation axis of the developer roller 112 through the roller body 115. The roller body 115 is arranged between a leftward wall 117 (see FIG. 3) and a rightward wall 118 (see FIG. 4) of the developer housing 111. A circumferential surface of the roller body 115 is partly exposed outward from the developer housing 111 to contact the circumferential surface of the photosensitive drum 43. Widthwise ends of the roller shaft 116 are rotatably supported by the leftward wall 117 and the rightward wall 118.

The supplier roller 113 is, as shown in FIG. 2, arranged inside the developer housing 111. A circumferential surface of the supplier roller 113 contacts a lower-frontward area of the circumferential surface of the developer roller 112.

The agitator 114 is arranged at a frontward position with respect to the supplier roller 113 and is attached to an agitator shaft 119, which extends in the widthwise direction. Widthwise ends of the agitator shaft 119 are rotatably supported by the leftward wall 117 and the rightward wall 118 of the developer housing 111.

On a leftward face of the leftward wall 117 in the developer housing 111, as shown in FIG. 3, arranged at an upper-frontward position with respect to the roller shaft 116 is a passive coupling 121. The passive coupling 121 has a cylindrical form, of which rotation axis extends in the widthwise direction.

On a rightward face of the rightward wall 118 in the developer housing 111, as shown in FIG. 4, arranged are a developer bias terminal 123 and a supplier bias terminal 124.

The developer bias terminal 123 may be made of electrically conductive resin and includes a contact portion 125, a connecting portion 126, and a fastened portion 127 integrally. The developer bias terminal 123 is electrically connected with the developer roller 112. The contact portion 125 is located at a frontward position with respect to the roller shaft 116 and has a plane surface that spreads in the front-rear direction and the vertical direction. The connecting portion 126 extends rearward from the contact portion 125 and includes an insertion hole 128, in which the roller shaft 116 is inserted. The fastened portion 127 extends upward from the contact portion 125 and fastened to the rightward wall 118 by a bolt 129.

The supplier bias terminal 124 may be made of electrically conductive resin and is arranged at an upper frontward position with respect to the developer bias terminal 123. The supplier bias terminal 124 is electrically connected with the supplier roller 113.

On the rightward wall 118, further, arranged at a frontward position with respect to the supplier bias terminal 124 is a newness detecting gear 131. The newness detecting gear 131 includes a missing tooth gear, in which a part of a circumferential surface thereof forms no tooth but has a smooth round surface. The newness detecting gear 131 is rotatable about an axis, which extends in the widthwise direction.

Meanwhile, on a downward surface of the leftward wall 91 in the cartridge frame 42, as shown in FIG. 5, arranged at a rearward position with respect to a center in the front-rear direction is a memory terminal 132.

<First Frame>

Figure 6:
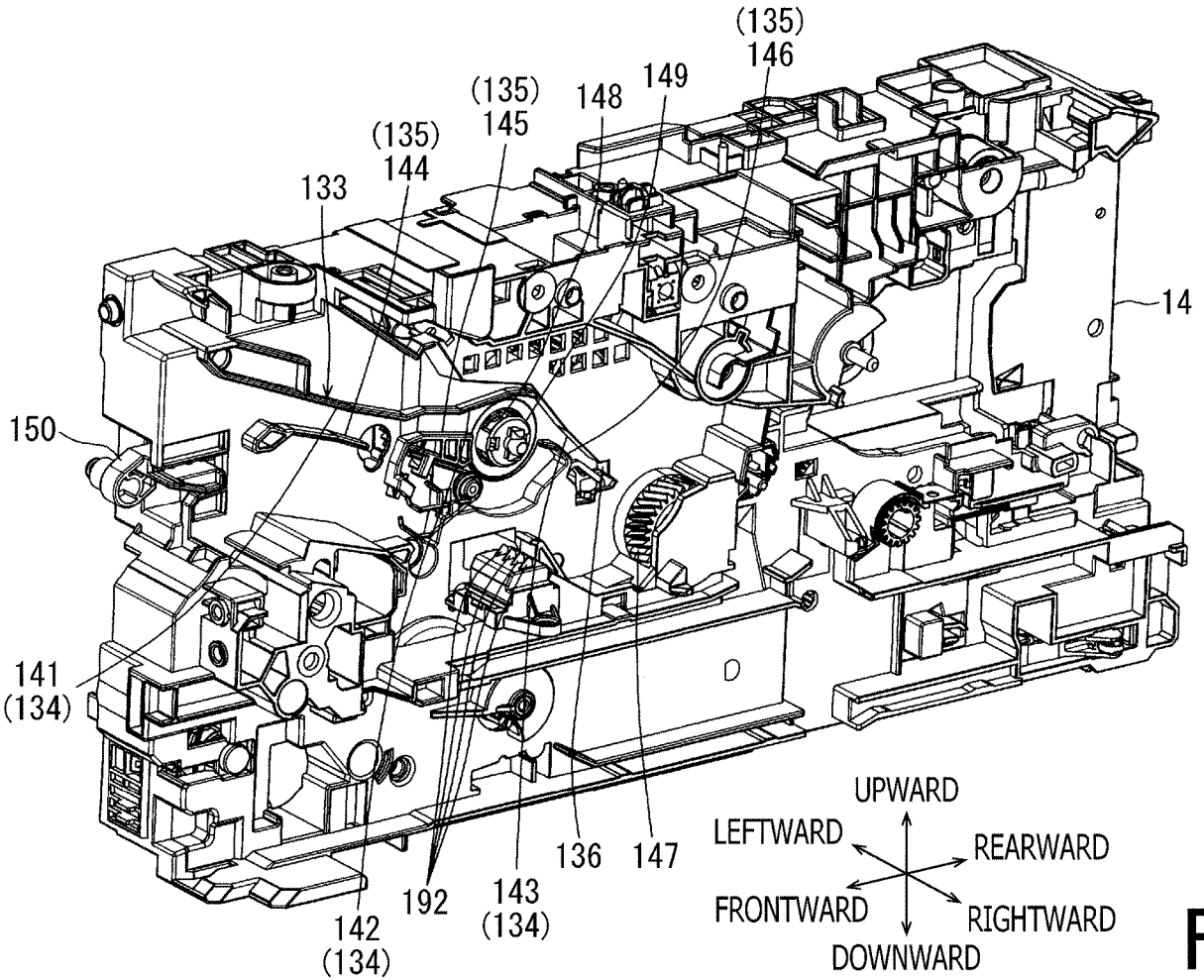
FIG. 6 is a perspective view of a first frame in the printer according to the embodiment of the present disclosure viewed from a leftward-front position.

The first frame 14 includes, as shown in FIG. 6, a guiding portion 133, which may guide the process cartridge 41 being attached to or detached from the housing 11. The guiding portion 133 includes an upper wall 134, a lower wall 135, and an end wall 136, which protrude rightward from a rightward surface 14R of the first frame 14.

The upper guide wall 134 includes a first wall surface 141, a second wall surface 142, and a third wall surface 143, which may be continuous in one piece. The first wall surface 141 extends lower-rearward from an upper-frontward position on the rightward surface 14R of the first frame 14. The second wall surface 142 extends rearward from a rearward end of the first wall surface 141. The third wall surface 143 extends lower-rearward from a rearward end of the second wall surface 142.

The lower guide wall 135 includes a fourth wall surface 144, a fifth wall surface 145, and a sixth wall surface 146. The fourth wall surface 144 extends nearly in parallel with the first wall surface 141 in the upper guide wall 134 at a lower spaced-apart position with respect to the first wall surface 141 of the upper guide wall 134. The fifth wall surface 145 extends lower-rearward at a lower spaced-apart position with respect to the second wall surface 142 of the upper guide wall 134. The sixth wall surface 146 extends nearly in parallel with the third wall surface 143 in the upper guide wall 134 at a lower-rearward spaced-apart position with respect to the third wall surface 143 of the upper guide wall 134.

The end wall 136 extends vertically between a rearward end of the third wall surface 143 of the upper guide wall 134 and a rearward end of the sixth wall surface 146 of the lower guide wall 135.

On the first frame 14, arranged at a position lower-rearward spaced-apart position with respect to the rearward end of the guiding portion 133 is a driving gear 147, which may mesh with the drum gear 102 in the process cartridge 41. The driving gear 147 is rotatably supported by the first frame 14 to rotate about an axis, which extends in the widthwise direction. The driving gear 147 may rotate by a driving force from a motor (not shown), which is arranged on a leftward side of the first frame 14.

Figure 7A:
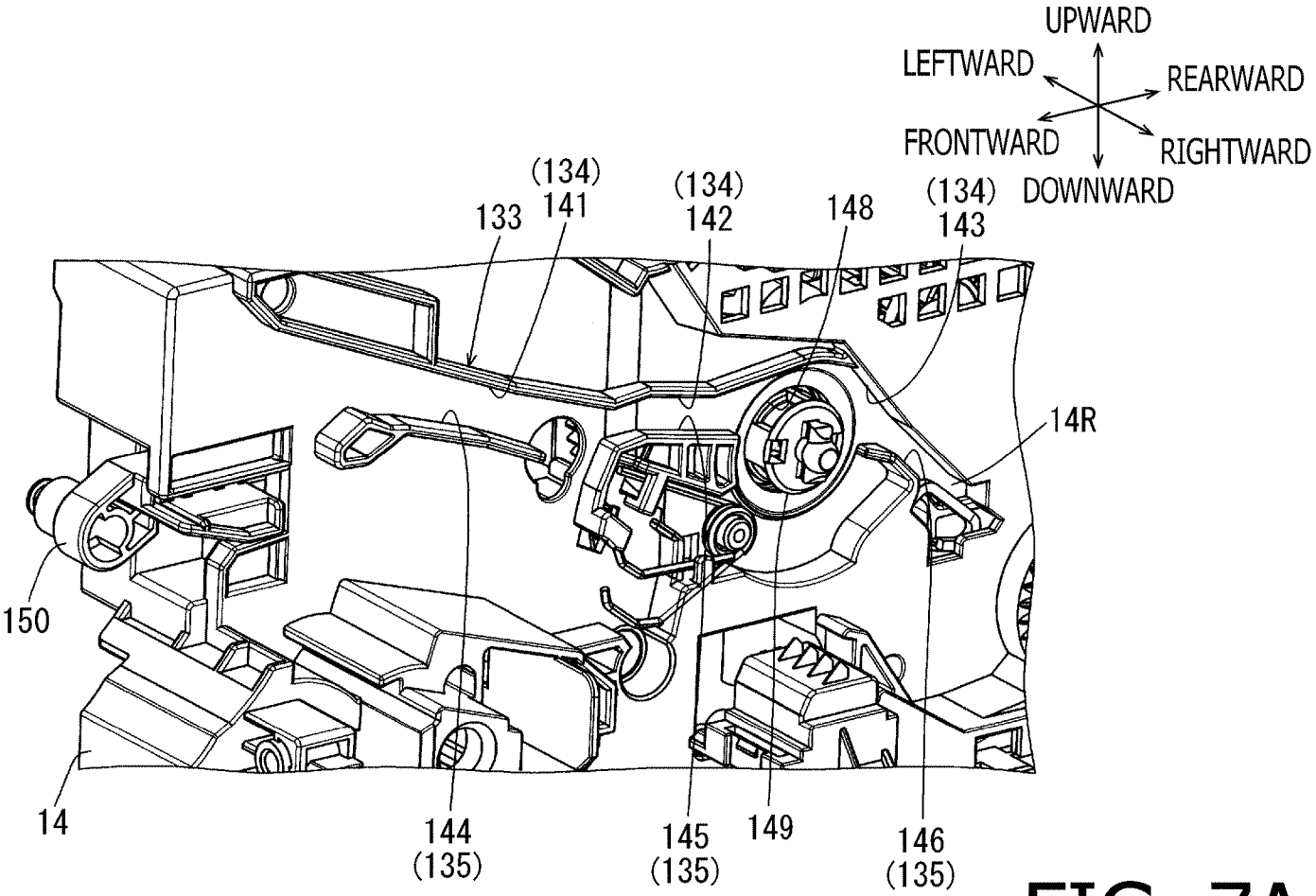
FIG. 7A is a perspective partial view of the first frame in the printer according to the embodiment of the present disclosure with a driving coupling at an extended position.
Figure 7B:
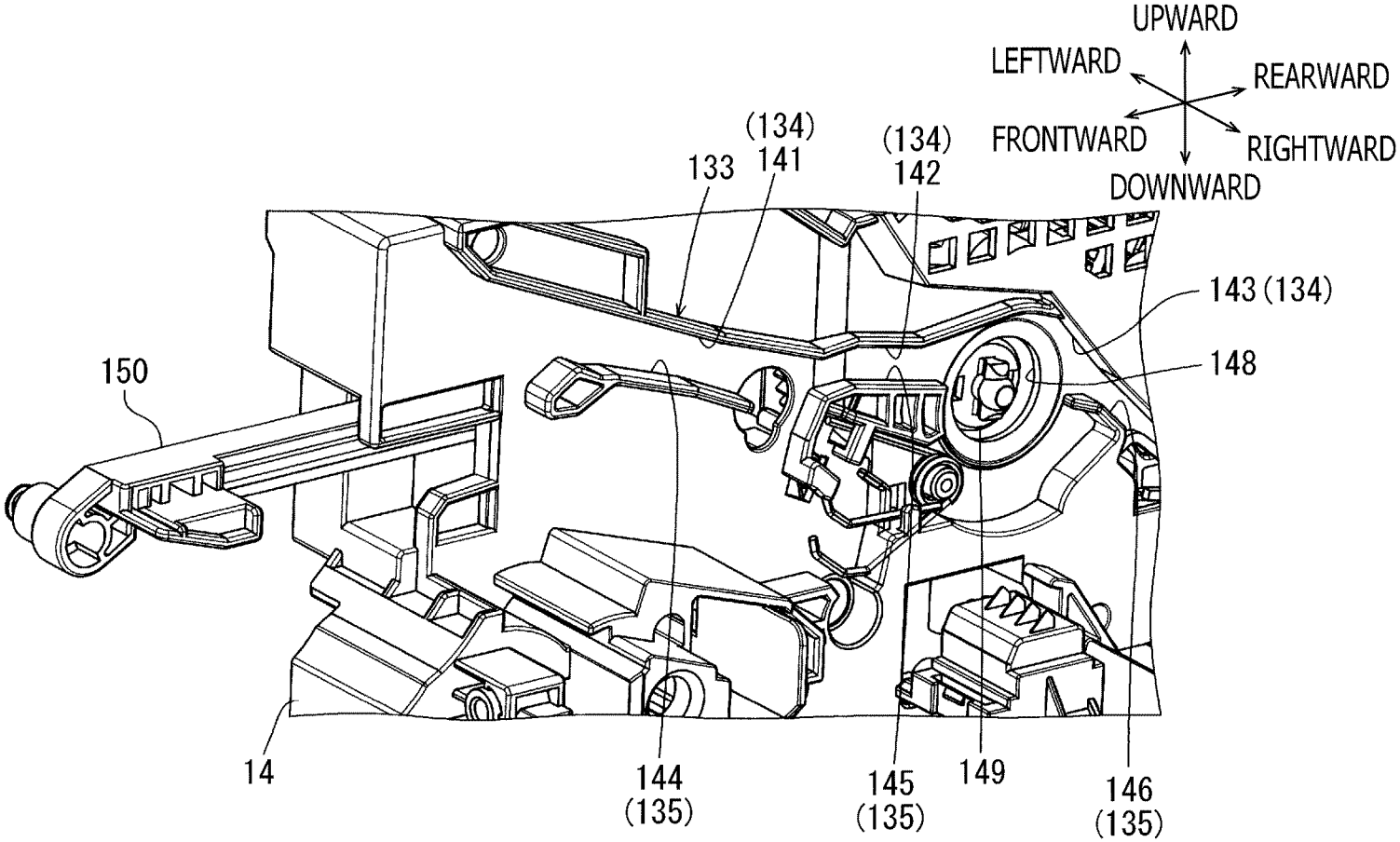
FIG. 7B is a perspective partial view of the first frame in the printer according to the embodiment of the present disclosure with the driving coupling at a retracted position.

The first frame 14 further includes a coupling port 148, which may be a circular opening, formed through the first frame 14 in the widthwise direction at a position to coincide with the passive coupling 121 when the process cartridge 41 is at the cartridge-attachment position P. Through the coupling port 148, a driving coupling 149 may move in the widthwise direction between an extended position (see FIG. 7A), in which the driving coupling 149 is extended rightward to the rightward side of the first frame 14, and a retracted position (see FIG. 7B), in which the driving coupling 149 retracts leftward to stay within the widthwise thickness of the coupling port 148. The driving coupling 149 is urged rightward by, for example, a spring (not shown) toward the extended position. The driving coupling 149 may rotate by a driving force transmitted from the motor (not shown), which is arranged on the leftward side of the first frame 14.

An arm 150 is inserted in the widthwise thickness of the first frame 14 through a frontward surface of the first frame 14. The arm 150 longitudinally extends in the front-rear direction. A frontward end of the arm 150 is coupled with the front cover 17 through a link device (not shown) so that the arm 150 may move frontward and rearward in conjunction with the front cover 17 moving between the open position and the closure position.

The arm 150 has a hole, which is not shown, formed through the arm 150 in the widthwise direction and elongated in the front-rear direction at a rearward end thereof, and the driving coupling 149 is inserted through the elongated hole. At a peripheral area around a rearward end of the elongated hole, formed is a retracting portion, which is thicker in the widthwise direction, and at an peripheral area around a frontward end of the elongated hole, formed is an extending portion, which is thinner in the widthwise direction. When the front cover 17 is in the open position, the arm 150 may be pulled frontward, and the arm 150 may contact the driving coupling 149 at the thicker retracting portion. Therefore, the driving coupling 149 may be moved to the retracted position shown in FIG. 7B. On the other hand, when the front cover 17 is in the closure position, the arm 150 may be pushed rearward, and the arm 150 may contact the driving coupling 149 at the thinner extending portion. Therefore, the driving coupling 159 may be moved by the urging force of the spring to the extended position shown in FIG. 7A.

<Second Frame>

Figure 8:
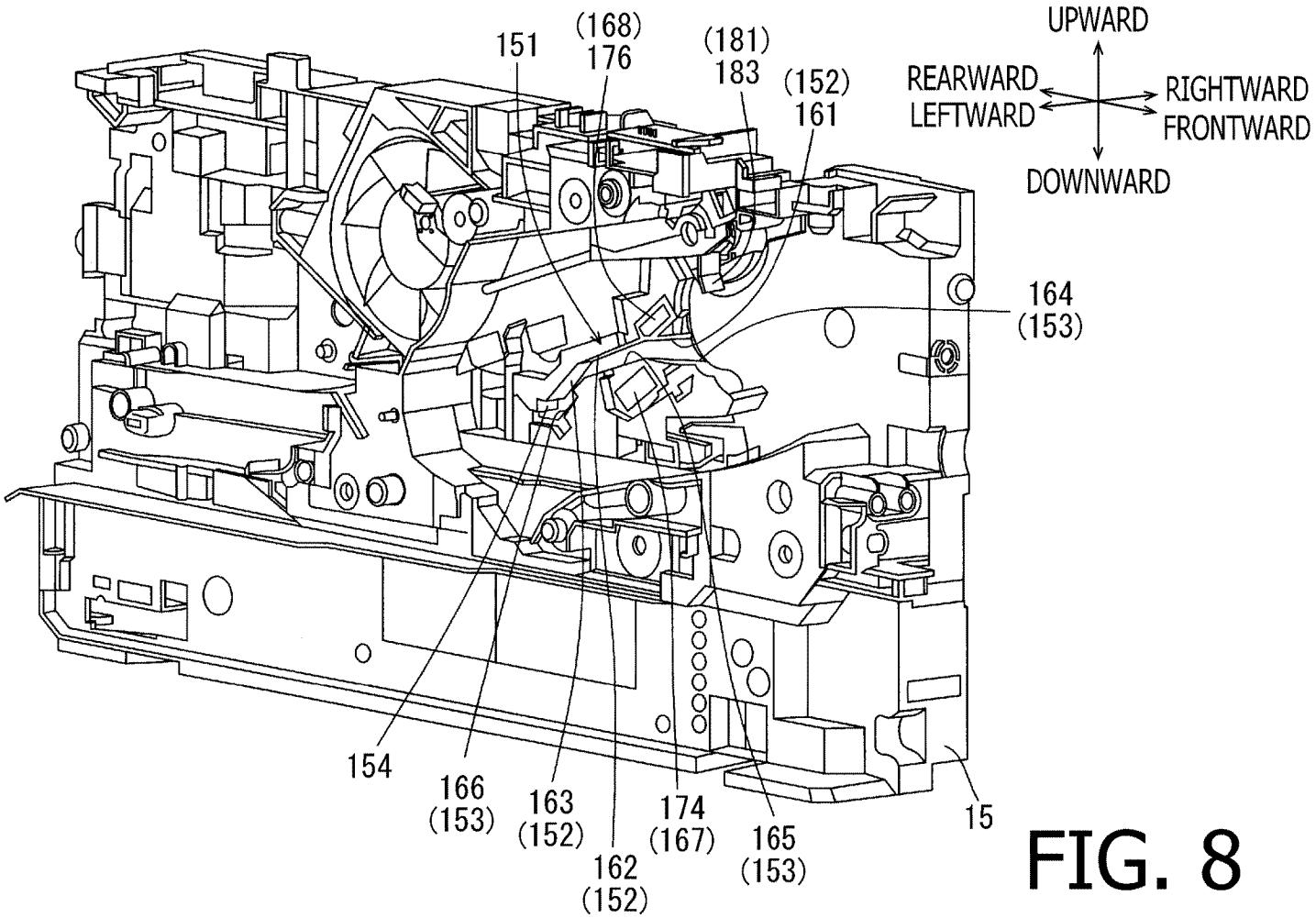
FIG. 8 is a perspective view of a second frame in the printer according to the embodiment of the present disclosure viewed from a leftward-front position.

The second frame 15 includes, as shown in FIG. 8, a guiding portion 151, which may guide the process cartridge 41 being attached to or detached from the housing 11. The guiding portion 151 includes an upper wall 152, a lower wall 153, and an end wall 154, which protrude leftward from a leftward surface of the second frame 15.

The upper guide wall 152 includes a first wall surface 161, a second wall surface 162, and a third wall surface 163, which may be continuous in one piece. The first wall surface 161 extends rearward from an upper position on the leftward surface of the second frame 15 with respect to a vertical center of the second frame 15. The second wall surface 162 extends lower-rearward from a rearward end of the first wall surface 161. The third wall surface 163 extends lower-rearward from a rearward end of the second wall surface 162 in a more acute inclination than the second wall surface 162.

The lower guide wall 153 includes a fourth wall surface 164, a fifth wall surface 165, and a sixth wall surface 166. The fourth wall surface 164 extends nearly in parallel with the first wall surface 161 of the upper guide wall 152 at a lower spaced-apart position with respect to the first wall surface 161. The fifth wall surface 165 extends lower-rearward nearly in parallel with the second wall surface 162 of the upper guide wall 152 at a lower spaced-apart position with respect to the second wall surface 162. The sixth wall surface 166 extends nearly in parallel with the third wall surface 163 in the upper guide wall 152 at a lower spaced-apart position with respect to the third wall surface 163.

The end wall 154 extends vertically between a rearward end of the third wall surface 163 of the upper guide wall 152 and a rearward end of the sixth wall surface 166 of the lower guide wall 153.

Figure 9:
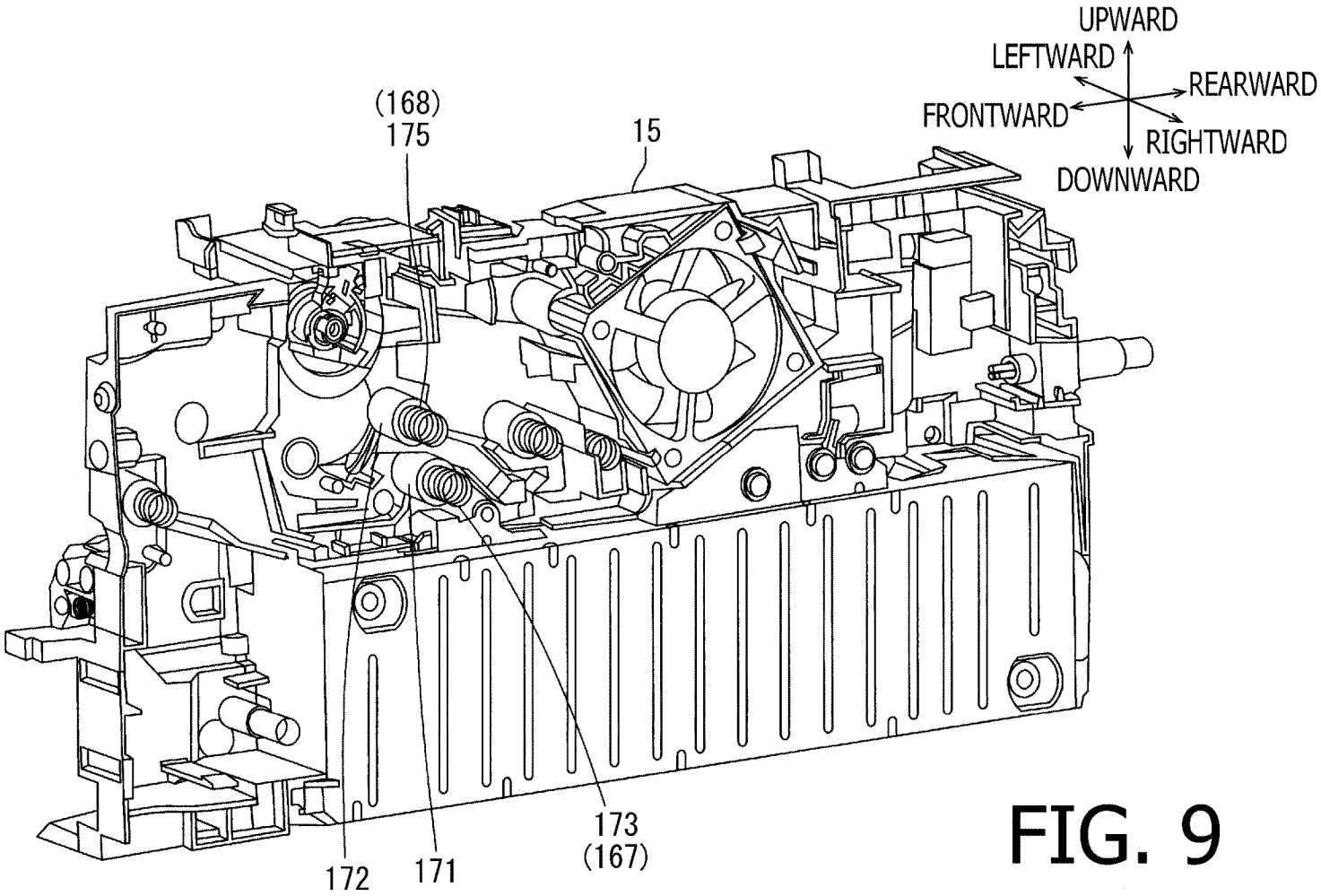
FIG. 9 is a perspective view of the second frame in the printer according to the embodiment of the present disclosure viewed from a rightward-front position.

On the second frame 15, arranged at a lower position with respect to the fifth wall surface 165 of the lower guide wall 153 is a developer bias electrode 167, which may supply developing electric power to the developer roller 112 through the developer bias terminal 123. Meanwhile, at an upper position with respect to the first wall surface 161 of the upper guide wall 152, arranged is a supplier bias electrode 168. On a rightward surface of the second frame 15, as shown in FIG. 9, formed are electrode housings 171, 172, which are in tubular forms to store the developer bias electrode 167 and the supplier bias electrode 168, respectively. The developer bias electrode 167 being a metal wire includes a coiled portion 173 and a contact portion 174 (see FIG. 8), which is formed in a round shape on a leftward side of the coiled portion 173, continuously in one piece. The supplier bias electrode 168 being a metal wire includes a coiled portion 175 and a contact portion 176 (see FIG. 8), which is formed in a round shape on a leftward side of the coiled portion 173, continuously in one piece. The contact portions 174, 176 are arranged to protrude leftward through the second frame 15 to be exposed leftward on the leftward surface of the second frame 15. Rightward ends of the coiled portions 173, 175 are fixed to the electrode housings 171, 172, respectively.

Figure 10:
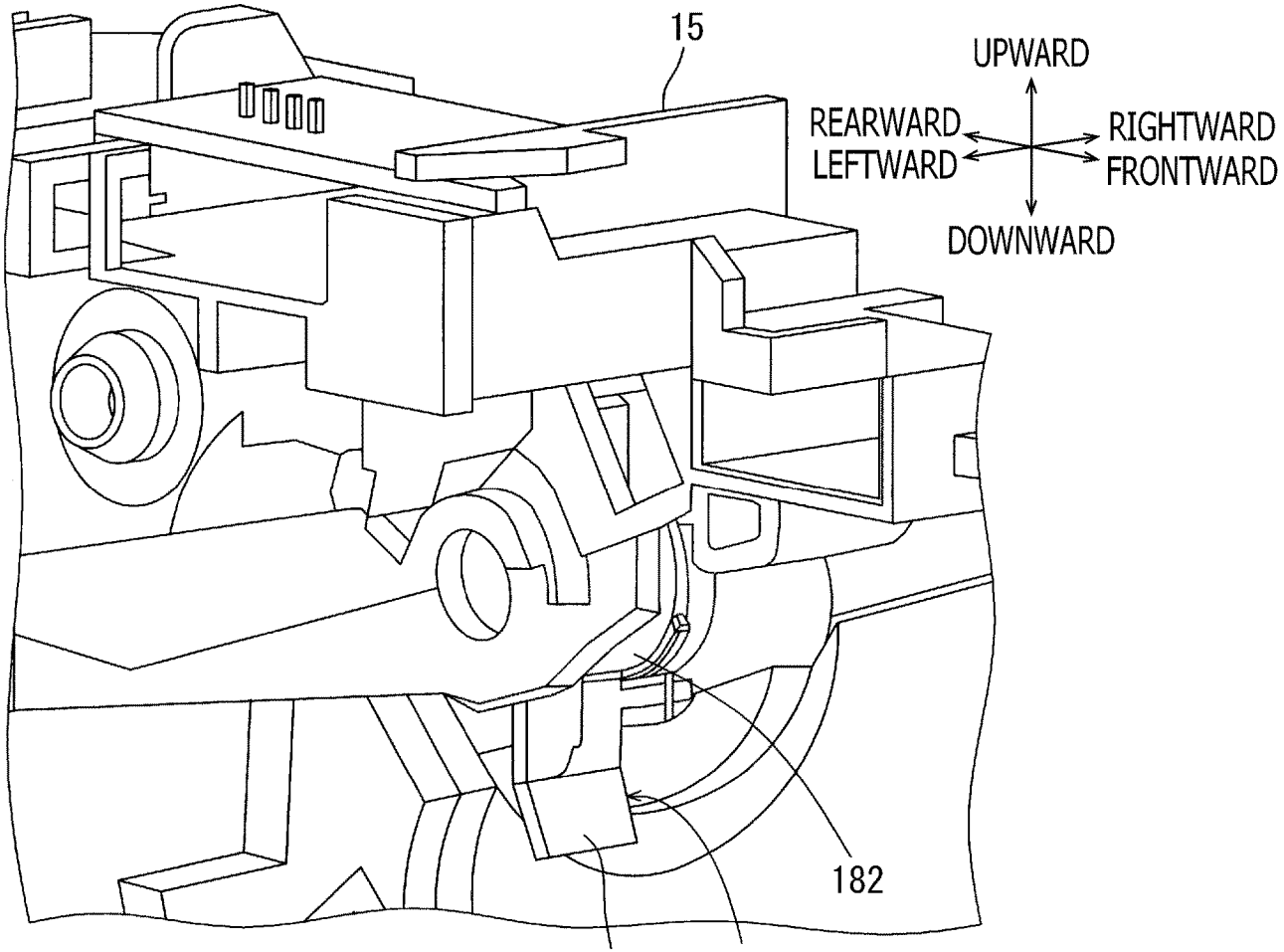
FIG. 10 is a perspective partial view of the second frame in the printer according to the embodiment of the present disclosure viewed from a leftward-front position.
Figure 11:
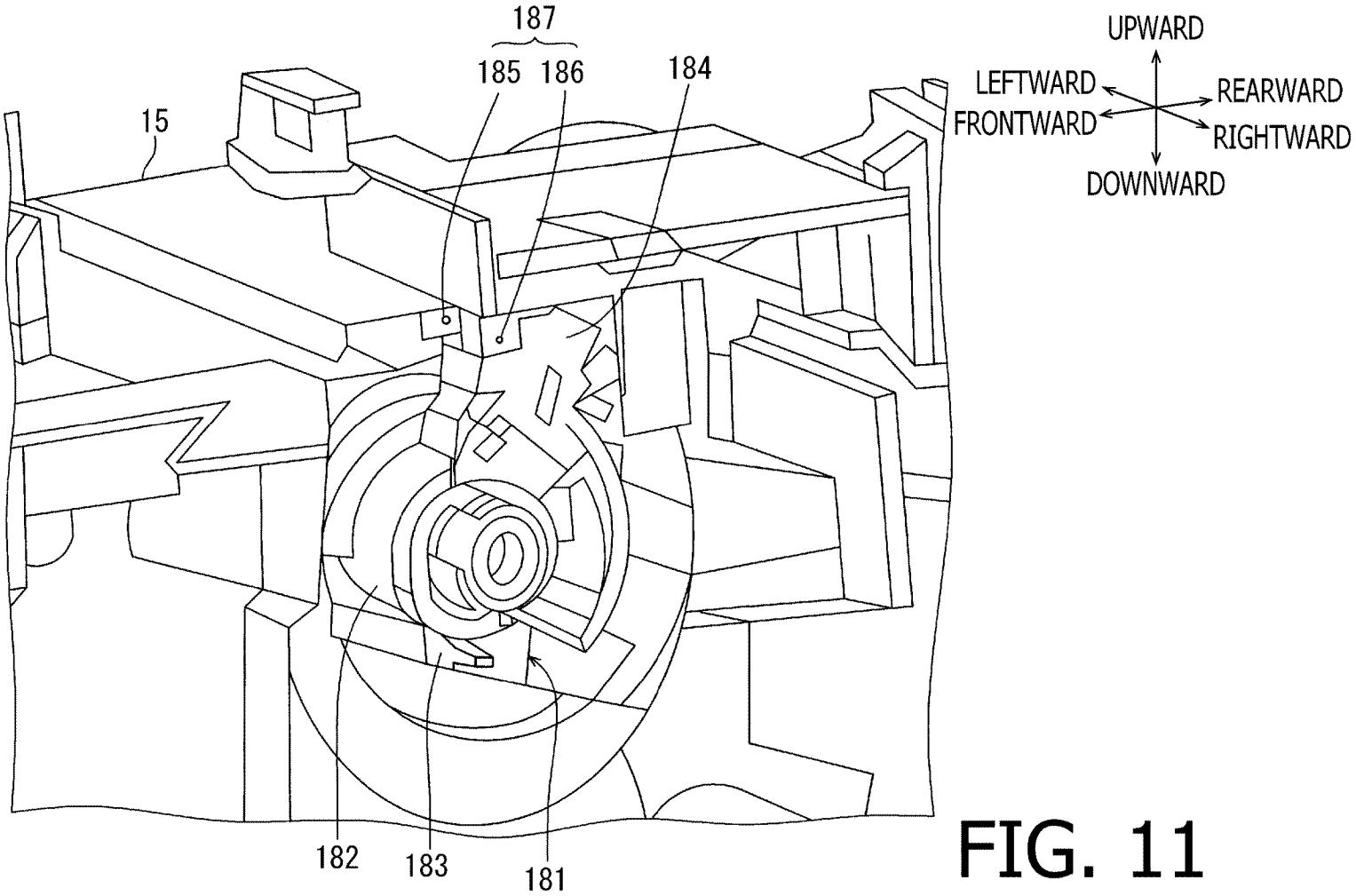
FIG. 11 is a perspective partial view of the second frame in the printer according to the embodiment of the present disclosure viewed from a rightward-front position.

To the second frame 15, as shown in FIG. 8, attached at an upper-frontward position with respect to the supplier bias electrode 168 is a newness detecting actuator 181. The newness detecting actuator 18 includes, as shown in FIG. 10, a base portion 182, which extends cylindrically in the widthwise direction, and an actuating portion 183, which extends downward from the base portion 182, continuously in one piece. The newness detecting actuator 181 further includes, as shown in FIG. 11, a light blocker 184 formed continuously in one piece with the base portion 182. The light blocker 184 extends upper-rearward from the base portion 182, when the process cartridge 41 is not at the cartridge-attachment position P. At a frontward position with respect to the light blocker 184, arranged are a light emitter 185 to emit light and a light-transmitting photo sensor 187, which has a light receiver 186 to receive the light from the light emitter 185.

<Third Frame>

Figure 12:
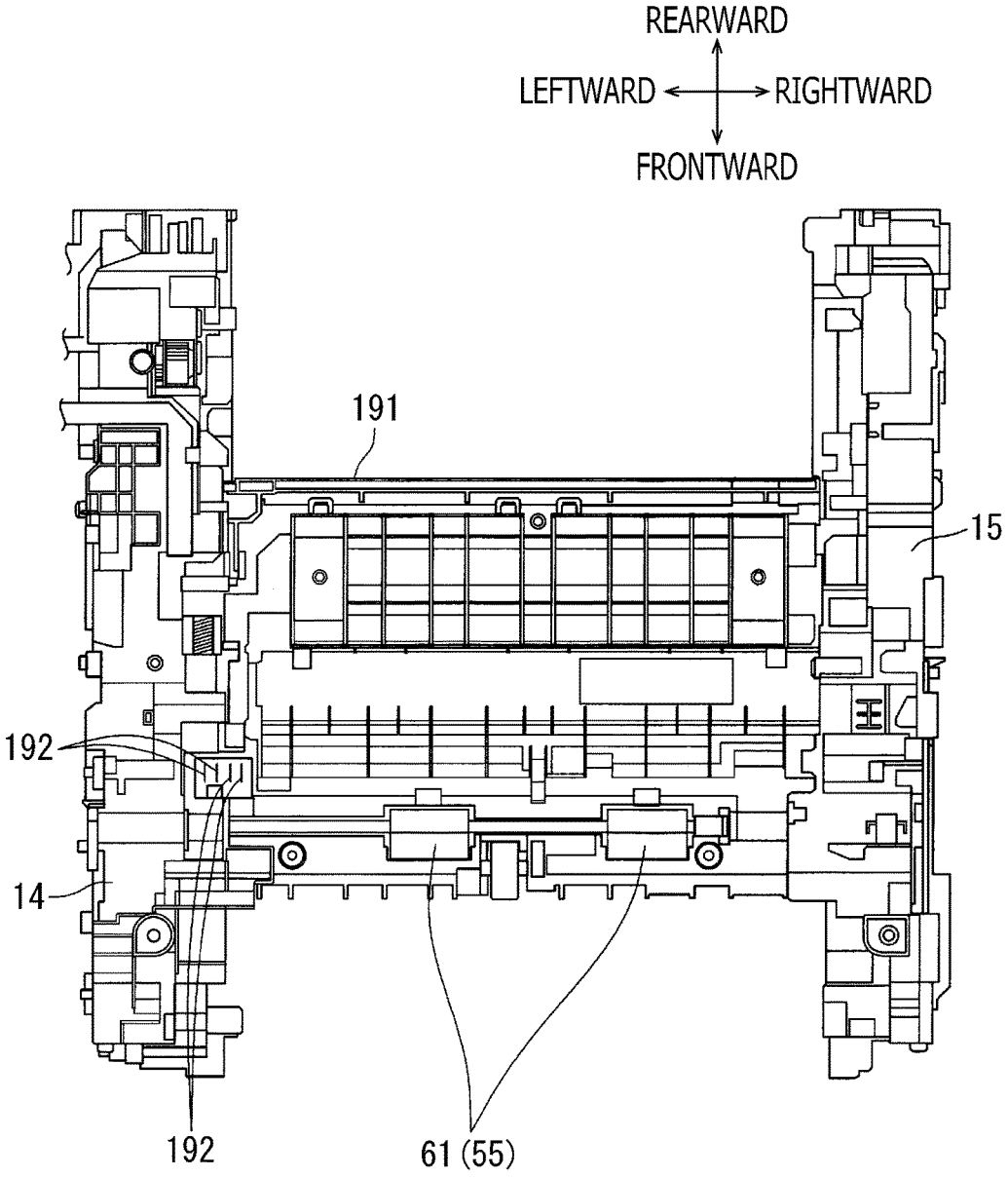
FIG. 12 is a plan view of the first frame, the second frame, and a third frame in the printer according to the embodiment of the present disclosure.

A third frame 191 is arranged through the intermediate area between the first frame 14 and the second frame 15, as shown in FIG. 12. The third frame 191 spreads, as shown in FIG. 2, in the front-rear direction and the widthwise direction at a lower position with respect to the cartridge-attachment position P.

To the third frame 191, as shown in FIG. 12, attached is a memory electrode 192. The memory electrode 192 is arranged in a leftward end area in the third frame 191 at a leftward outside position with respect to a range S, where the sheet being conveyed may pass through. The memory electrode 192 is located in a central area in the front-rear direction in the third frame 191 at a position between the transfer roller 46 and the registration roller 55, when the process cartridge 41 is at the cartridge-attachment position P. The memory electrode 192 protrudes upward to be higher than an upper surface of the third frame 191.

<Electric Configuration of the Printer>

Figure 13:
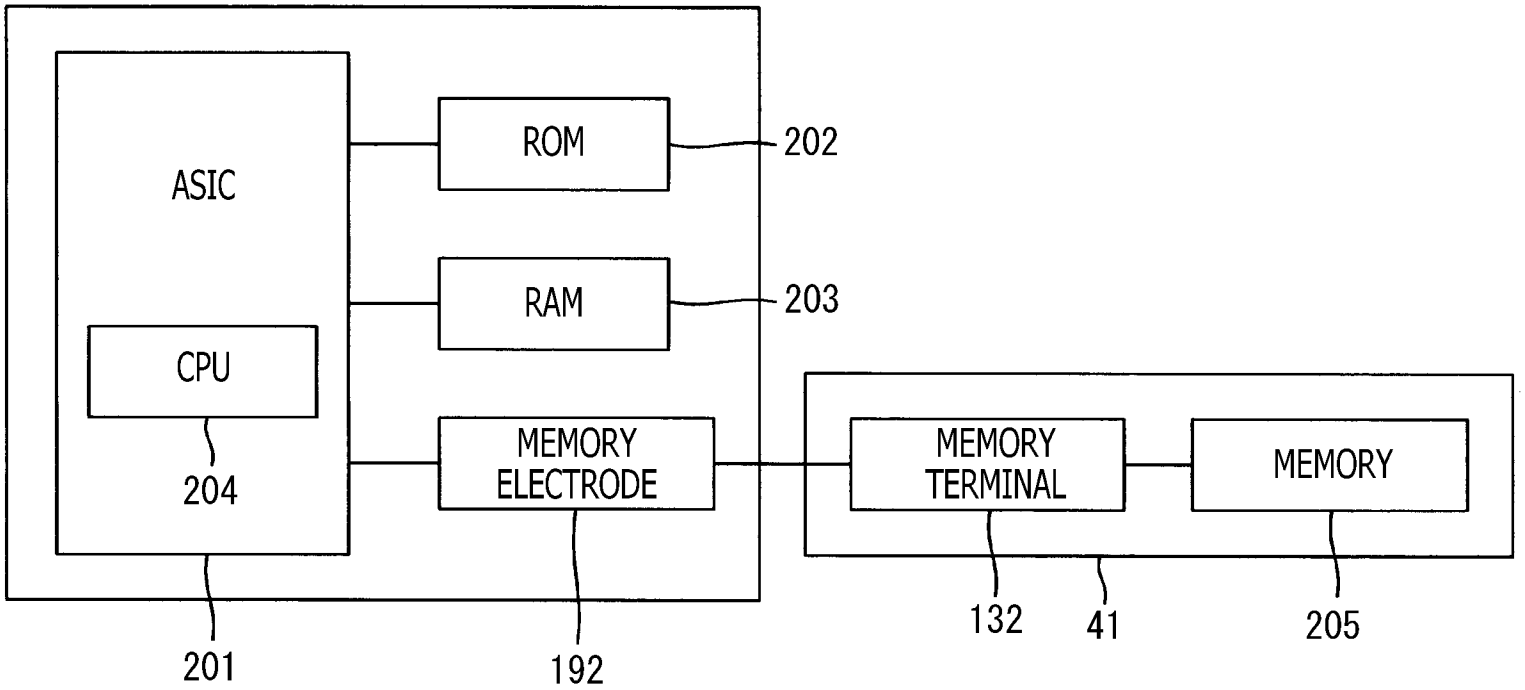
FIG. 13 is a block diagram to illustrate an electric configuration in the printer according to the embodiment of the present disclosure.

The printer 1 is equipped with, as shown in FIG. 13, a controller, including an application specific integrated circuit (ASIC) 201, a ROM 202, and a RAM 203, to control behaviors of the parts and the devices in the printer 1.

The ASIC 201 is connected with the ROM 202, the RAM 203, and the other parts and the devices that are to be controlled by the ASIC 201. The ASIC 201 includes a CPU 204, which may execute programs stored in the ROM 202 based on signals input to the ASIC 201 to control the parts and the devices. While the programs run, the RAM 203 may be used as a work area for the CPU 204.

The ASIC 201 is electrically connected with the memory electrode 192. Meanwhile, the process cartridge 41 has a memory 205 to store information concerning the process cartridge 41, such as, for example, a product number of the process cartridge 41. The memory 205 is connected with the memory terminal 132 attached to the cartridge frame 42.

<Attachment and Detachment of the Process Cartridge>

The process cartridge 41 may be attached to the cartridge-attachment position P between the first frame 14 and the second frame 15 in the housing 11 through the opening 13 when the front cover 17 is in the open position. When the process cartridge 41 enters the housing 11 through the opening 13, the leftward end of the drum shaft 101 may enter an area between the upper guide wall 134 and the lower guide wall 135 in the guiding portion 133, and the leftward end of the drum shaft 101 may enter an area between the upper guide wall 152 and the lower guide wall 153 in the guiding portion 151. As the process cartridge 41 is pushed rearward, the leftward end and the rightward end of the drum shaft 101 may move along the guiding portions 133, 151, respectively, so that the process cartridge 41 may descend lower-rearward to approach the cartridge-attachment position P.

When the leftward end and the rightward end of the drum shaft 101 contact the end walls 136, 154, respectively, the process cartridge 41 may be restricted from moving further rearward. With the restriction, the process cartridge 41 may be located at the cartridge-attachment position P, where the process cartridge 41 may be supported by the third frame 191 at the lower position. Thus, the process cartridge 41 may be completely attached to the cartridge-attachment position P.

While the process cartridge 41 is at the cartridge-attachment position P, the drum gear 102 in the process cartridge 41 may mesh with the driving gear 147 attached to the first frame 14. Therefore, the driving force from the motor may be transmitted through the driving gear 147 to the drum bear 102 so that the driving force may rotate the photosensitive drum 43.

Meanwhile, the leftward end of the drum shaft 101 may contact a frontward surface of the end wall 136 and may be supported by the lower guide wall 135 from below, and the rightward end of the drum shaft 101 may contact a frontward surface of the end wall 154 and may be supported by the sixth wall surface 166 in the lower guide wall 153 from below. Further, the developer bias terminal 123 and the supplier bias terminal 124 in the process cartridge 41 may resiliently contact the developer bias electrode 167 and the supplier bias electrode 168 in the second frame 15 to establish electrical connection, respectively. Due to the resiliency of the developer bias electrode 167 and the supplier bias electrode 168, the process cartridge 41 may be pushed leftward, and the leftward end of the drum shaft 101 may contact the rightward surface 14R of the first frame 14. Therefore, the process cartridge 41 may be located at a correct position in the widthwise direction with respect to the rightward surface 14R of the first frame 14 within the cartridge-attachment position P.

Meanwhile, the memory terminal 132 on the process cartridge 41 may contact the memory electrode 192 attached to the third frame 191 from above at a downward surface thereof. In this regard, the memory electrode 192 has a substantial height to contact the memory terminal 132 on the process cartridge 41 under the condition where the process cartridge 41 is at the cartridge-attachment position P. Thereby, the memory terminal 132 and the memory electrode 192 may be electrically connected, and the ASIC 201 and the memory 205 on the process cartridge 41 may be connected to exchange data there-between.

Meanwhile, the passive coupling 121 in the process cartridge 41 is at the position to coincide with the coupling port 148 in the first frame 148 on the leftward side. As the front cover 17 is moved from the open position to the closure position, the driving coupling 149 may move from the retracted position to the extended position and couple with the passive coupling 121. Thereby, the driving force from the motor may be input to the passive coupling 121 through the driving coupling 149. The driving force to be input to the passive coupling 121 may be distributed to the developer roller 112, the supplier roller 113, and the agitator 114 through gear trains (not shown) to rotate the developer roller 112, the supplier roller 113, and the agitator 114, respectively.

The actuating portion 183 of the newness detecting actuator 181 attached to the second frame 15 is located leftward with respect to the newness detecting gear 131 in the process cartridge 41. If the process cartridge 41 currently at the cartridge-attachment position P is an unused process cartridge 41, and when the agitator 114 in the unused process cartridge 41 rotates for the first time, rotation of the agitator shaft 119 may be transmitted to the newness detecting gear 131 through a gear (not shown) attached to the rightward end portion of the agitator shaft 119 and rotate the newness detecting gear 131. When the newness detecting gear 131 rotates to a position, in which the tooth-missing portion of the newness detecting gear 131 faces with the gear on the agitator shaft 119, the gear on the agitator shaft 119 and the newness detecting gear 131 may be unmeshed, and the newness detecting gear 131 may stop rotating. Meanwhile, the agitator 114 may continue rotating.

Before the newness detecting gear 131 stops rotating, a protrusion (unsigned) formed on a rightward surface of the newness detecting gear 131 may contact the actuating portion 183 in the newness detecting actuator 181. As the newness detecting gear 131 continues rotating with the protrusion contacting the actuating portion 183, the newness detecting actuator 181 may swing, and the light blocker 184 in the newness detecting actuator 181 may block a light path for the light in the optical sensor 187. Therefore, the process cartridge 41 being an unused condition may be detected.

In order to remove the process cartridge 41 from the housing 11, the front cover 17 may be moved from the closure position to the open position. As the front cover 17 moves to the closure position, the driving coupling 149 may retract from the extended position to the retracted position, and the driving coupling 149 and the passive coupling 121 may be disengaged. The process cartridge 41 may be pulled frontward from the cartridge-attachment position P, and the leftward end and the rightward end of the drum shaft 101 may move along the guiding portions 133, 151, respectively, so that the process cartridge 41 may be guided to ascend in the housing 11. When the process cartridge 41 exits the housing 11 through the opening 13, the process cartridge 41 may be completely removed from the housing 11.

Meanwhile, the process cartridge 41 being removed from the cartridge-attachment position P may contact the actuating portion 183 in the newness detecting actuator 181. By the contact, the newness detecting actuator 181 may swing to yield the position to the process cartridge 41; therefore, the process cartridge 41 may continue moving to be removed without being interfered with by the newness detecting actuator 181.

<Benefits>

According to the configuration described above, the process cartridge 41 has the photosensitive drum 43, the developer housing 111, and the developer roller 112. The toner contained in the developer housing 111 may be supplied to the photosensitive drum 43 through the developer roller 112 so that a toner image may be carried on the photosensitive drum 43.

The process cartridge 41 has the memory terminal 132, which is attached to the downward face of the process cartridge 41, to be electrically connected with the memory 205 storing information concerning the process cartridge 41. Meanwhile, when the process cartridge 41 is at the cartridge-attachment position P, the memory electrode 192 may contact the memory terminal 132 of the memory 205 so that the memory 205 may be electrically connected with the ASIC 201. Therefore, it may not be necessary that the memory electrode 192 is moved when the process cartridge 41 is attached to and detached from the cartridge-attachment position P. In other words, a device or mechanism to move the memory electrode 192 in conjunction with the attaching or detaching motion of the process cartridge 41 is not necessary. In this regard, the printer 1 may be downsized.

The memory electrode 192 is arranged at the position leftward displaced from the range S, which may be the path for the sheet being conveyed, and may not interfere with the sheet being conveyed. Therefore, the sheet may be smoothly and preferably conveyed.

While the process cartridge 41 is at the cartridge-attachment position P, the developer bias terminal 123 and the supplier bias terminal 124 in the process cartridge 41 may resiliently contact the developer bias electrode 167 and the supplier bias electrode 168 in the second frame 15, respectively. Therefore, the process cartridge 41 may be pushed leftward so that the drum shaft 101 may contact the rightward surface 14R of the first frame 14, and the process cartridge 41 may be placed at a correct widthwise position on basis of the rightward surface 14R of the first frame 14 within the cartridge-attachment position P.

While the process cartridge 41 may be placed at the correct widthwise position with reference to the first frame 14, it may be noted that the memory electrode 192 is located at the position in the vicinity of the first frame 14. In this regard, the positional relation between the memory terminal 132 and the memory electrode 192 may be maintained stably. Therefore, the electrical connection between the memory terminal 132 and the memory electrode 192 may be preferably maintained.

Meanwhile, the positional relation between the newness detecting gear 131 and the newness detecting actuator 181 may not necessarily be maintained as accurately as the positional relation between the memory terminal 132 and the memory electrode 192. Therefore, the newness detecting gear 131 and the newness detecting actuator 181 may be arranged at the positions closer to the second frame 15 rather than the first frame 14 so that the parts and the devices in the printer 1 may not unevenly be arranged in the vicinity of the first frame 14 but may be distributed rather evenly between the first frame 14 and the second frame 15. Accordingly, degree of freedom in layout of the parts and the devices in the printer 1 may be improved.

MORE EXAMPLES

Although an example of carrying out the invention have been described, those skilled in the art will appreciate that there are numerous variations and permutations of the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the present disclosure may not necessarily be embodied in the single-functioned printer 1 but may be embodied in a multi-functioned image processing apparatus such as a facsimile machine or a multifunction peripheral having an image forming function and an image reading function.

What is claimed is:

1. An image forming apparatus operable in conjunction with a cartridge, the cartridge comprising a photosensitive drum configured to carry an image thereon, a developer roller configured to supply toner to the photosensitive drum, a passive coupling, a memory and a terminal arranged on a downward surface of the cartridge, the terminal being electrically connected with the memory, the image forming apparatus comprising:

a housing having an opening, through which the cartridge is detachably attachable to the housing;

a controller arranged inside the housing; and a supporter configured to support the cartridge at an attachment position, the supporter comprising a first frame comprising a driving coupling configured to supply a driving force to the passive coupling of the cartridge, and a guiding portion configured to guide the cartridge to be moved from the opening of the housing to the attachment position and to guide the terminal of the cartridge to approach and contact a memory electrode of the supporter, a second frame comprising a bias electrode configured to supply power to the developer roller of the cartridge, the second frame being arranged to face the first frame across the attachment position, and a third frame arranged between the first frame and the second frame, the third frame comprising the memory electrode, which protrudes upward to extend above an upper surface of the third frame, the memory electrode being electrically connected with the controller and disposed on the third frame at a position that is closer to the first frame than the second frame;

wherein, when the cartridge is attached to the supporter at the attachment position, a separation between a position where the passive coupling of the cartridge couples with the driving coupling and the third frame is larger than a separation between a position where the terminal of the cartridge contacts the memory electrode and the third frame.

2. The image forming apparatus according to claim 1 further comprising:

a sheet conveyer configured to convey a sheet toward the photosensitive drum in the cartridge at the attachment position;

a registration roller configured to regulate a position of the sheet conveyed by the sheet conveyer with respect to the photosensitive drum; and a transfer roller arranged downstream with respect to the registration roller in a conveying direction to convey the sheet, the transfer roller being configured to transfer the image in the toner carried on the photosensitive drum to the sheet;

wherein the memory electrode is arranged at a position between the registration roller and the transfer roller along the conveying direction.

3. The image forming apparatus according to claim 2, wherein the memory electrode is disposed outside an area where the sheet conveyed by the sheet conveyer passes through.

4. The image forming apparatus according to claim 1, the first frame further comprising a positioning portion configured to contact the cartridge supported by the supporter and to locate the cartridge at the attachment position; and the image forming apparatus further comprising a resilient member arranged on the second frame, the resilient member being configured to press the cartridge supported by the supporter against the positioning portion.

5. The image forming apparatus according to claim 4, wherein the resilient member is the bias electrode.

6. The image forming apparatus according to claim 1, the cartridge further comprising a newness detecting member located at a predetermined position when the cartridge is in an unused condition, the newness detecting member being configured to move to a position that is different from the predetermined position once the cartridge is used to supply the toner to the image on the photosensitive drum; and the image forming apparatus further comprising a newness detecting actuator configured to contact the newness detecting member of the cartridge and detect a position of the newness detecting member, the newness detecting actuator being arranged at a position that is closer to the first frame than the second frame;

wherein the memory electrode is arranged at a position that is closer to the second frame than the first frame.

* * * * *